US011299365B2

(12) United States Patent
Rohman et al.

(10) Patent No.: US 11,299,365 B2
(45) Date of Patent: Apr. 12, 2022

(54) VARIABLE ROTATION OF PADDLE FOR FINISHER

(71) Applicant: HEWLETT-PACKARD DEVELOPMENT COMPANY, L.P., Spring, TX (US)

(72) Inventors: Stephen Thomas Rohman, Clackamas, OR (US); Matthew Raisanen, Battle Ground, WA (US); Sundae Kim, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/046,604

(22) PCT Filed: May 11, 2018

(86) PCT No.: PCT/US2018/032284
§ 371 (c)(1),
(2) Date: Oct. 9, 2020

(87) PCT Pub. No.: WO2019/216914
PCT Pub. Date: Nov. 14, 2019

(65) Prior Publication Data

US 2021/0122601 A1 Apr. 29, 2021

(51) Int. Cl.

| | |
|---|---|
| ***B65H 31/36*** | (2006.01) |
| ***B65H 43/00*** | (2006.01) |
| *B42C 1/12* | (2006.01) |

(52) U.S. Cl.
CPC ..... *B65H 31/36* (2013.01); *B65H 43/00* (2013.01); *B42C 1/125* (2013.01); *B65H 2301/4212* (2013.01); *B65H 2301/4213* (2013.01); *B65H 2403/942* (2013.01); *B65H 2404/1114* (2013.01); *B65H 2405/11151* (2013.01); *B65H 2511/13* (2013.01); *B65H 2511/152* (2013.01); *B65H 2511/30* (2013.01); *B65H 2801/27* (2013.01)

(58) Field of Classification Search
CPC combination set(s) only.
See application file for complete search history.

(56) References Cited

U.S. PATENT DOCUMENTS

| | | | |
|---|---|---|---|
| 8,712,314 | B2 | 4/2014 | Kubo et al. |
| 2008/0213017 | A1 | 9/2008 | Morisawa et al. |
| 2008/0317534 | A1 | 12/2008 | Taki et al. |

(Continued)

FOREIGN PATENT DOCUMENTS

| | | | | |
|---|---|---|---|---|
| EP | 1770041 | A1 | 4/2007 | |
| EP | 3241792 | A1 * | 11/2017 | ..... B65H 31/36 |

(Continued)

*Primary Examiner* — Jennifer Bahls
(74) *Attorney, Agent, or Firm* — Staas & Halsey LLP

(57) ABSTRACT

An paddle apparatus for a finisher includes a rotatable shaft and a paddle coupled to the rotatable shaft. The paddle is rotatable in a forward direction to compile a recording medium toward an end of a register tray of the finisher, and is rotatable in a reverse direction to apply a downward force to the compiled recording medium. An amount that the paddle is rotated in the reverse direction can be varied based on a height of the compiled recording medium in the register tray.

15 Claims, 8 Drawing Sheets

(56) References Cited

U.S. PATENT DOCUMENTS

| | | | | |
|---|---|---|---|---|
| 2011/0063690 | A1 | 3/2011 | Miyazaki | |
| 2021/0078820 | A1 * | 3/2021 | Furumido | B65H 31/02 |

FOREIGN PATENT DOCUMENTS

| | | | |
|---|---|---|---|
| JP | 11-301912 | | 11/1999 |
| JP | 2003-34458 | | 2/2003 |
| KR | 10-2011-0083080 | | 7/2011 |
| KR | 10-1404733 | | 6/2014 |
| KR | 10-2017-0125477 | | 11/2017 |
| KR | 20170125477 A | * | 11/2017 |

* cited by examiner

VARIABLE ROTATION OF PADDLE FOR FINISHER

CROSS REFERENCE TO RELATED APPLICATIONS

This application is filed under 35 U.S.C. § 371 as a National Stage of PCT International Application No. PCT/US2018/032284, filed on May 11, 2018, in the U.S. Patent and Trademark Office, the disclosure of which is incorporated by reference herein in its entirety.

BACKGROUND

A finisher refers to an apparatus for processing a recording medium, such as paper, supplied from an image forming apparatus. The finisher can be connected to the image forming apparatus to receive the recording medium during a job, and is in communication with the image forming apparatus. For example, the finisher may perform a stapling operation, an alignment operation, and/or a folding operation with respect to the recording medium supplied from the image forming apparatus.

An image forming apparatus refers to an apparatus that forms images on a recording medium according to inputted signals. Examples of an image forming apparatus include a printer, a copy machine, a scanner, a facsimile, and a multi-function peripheral device that combines and implements various functions of the printer, copy machine, scanner, and/or facsimile. Examples of a printer include an inkjet printer or a laser printer.

DETAILED DESCRIPTION

Figure 1:
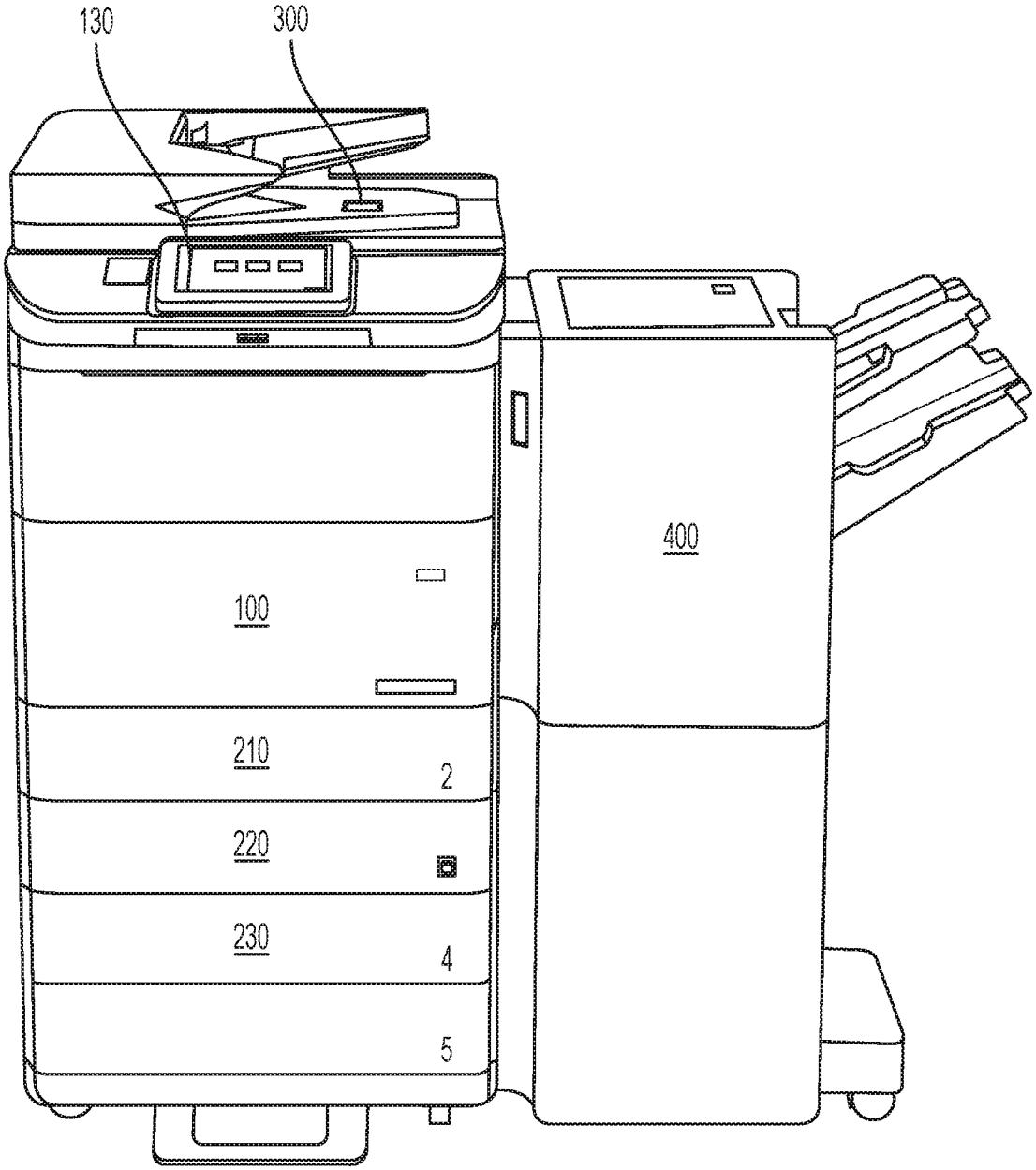
FIG. 1 is a schematic structural diagram of an image forming apparatus and finisher according to an example.

A type of recording medium, environmental conditions, and an amount of ink content on a page, are example factors that may affect the quality of a finishing operation by the finisher. The recording medium may include, for example, paper such as glossy paper, plain paper, art paper, overhead projector film, cardstock, and the like. For example, pages of recording media may tend to over-compile or buckle, resulting in a paper jam or a stapled job with bad edge registration. Therefore, it may be difficult to successfully compile stapled jobs for various media types, environmental conditions, and recording media having a certain amount of ink content on a page.

A finisher includes a paddle on a rotatable shaft which is rotatable in a forward direction to compile a recording medium toward an end of a register and to rotate in a reverse direction to push down a buckle in the recording medium. An amount of rotation of the paddle in the reverse direction can be controlled so as to be variable based on a height of the compiled recording medium. For example, a controller of the finisher can transmit a signal or command to a driving source coupled to the rotatable shaft so that the driving source rotates the rotatable shaft by a specified amount in the reverse direction during compiling. The driving source may be a motor, for example. Therefore, compiling of recording media may be accomplished more successfully by decreasing or preventing an amount of buckling of the recording medium during compiling despite variations in media type, environmental conditions, or ink content on a page of a recording medium.

Various examples of the disclosure will now be described in greater detail with reference to the accompanying drawings, wherein like reference characters denote like elements. Examples to be explained in the following may be modified and implemented in various different forms.

When it is stated in the disclosure that one element is "connected to" or "coupled to" another element, the expression encompasses not only an example of a direct connection or direct coupling, but also a connection with another element interposed therebetween. Further, when it is stated herein that one element "includes" another element, unless otherwise stated explicitly, it means that yet another element may be further included rather than being excluded.

FIG. 1 is a schematic structural diagram of an image forming apparatus and finisher 400 according to an example. Referring to FIG. 1, the image forming apparatus includes a printer 100 and a scanner 300 coupled to a finisher 400.

The printer 100 prints an image on a sheet-type medium, which may also be referred to as a recording medium, provided from a paper feeder. The paper feeder may be, for example, a main cassette feeder 210 installed under the printer 100, or secondary cassette feeders 220 and 230 installed under the main cassette feeder 210. Although not illustrated, the paper feeder may further include a multi-purpose tray (MPT), a high capacity feeder installed at a side of the printer 100, or a combination thereof.

The printer 100 may also include a control panel 130 to receive an input from a user to control the image forming apparatus, for example to perform a function of the image forming apparatus. The control panel 130 may include a keyboard, a button, a display, or combinations thereof for the user to operate the image forming apparatus. The display may be a touchscreen to receive the input from the user.

The printer 100 may print an image on a recording medium by using various printing methods such as an electrophotography method, an inkjet method, a thermal transfer method, and a thermal sublimation method. For example, the image forming apparatus may print a color image on the recording medium by using an inkjet method. The printer 100 may be a S path-type of printer or a C path-type of printer, for example.

The scanner 300 reads an image recorded on a document. The scanner 300 may have any of various structures such as a flatbed mechanism where a document is at a fixed position and an image is read while a reading member is moved, a document feeding mechanism where a reading member is at a fixed position and a document is fed, and a combination structure thereof.

The finisher 400 may include a sheet folding device (not illustrated) for folding, one or more times, the recording medium discharged from the printer 100. The finisher 400 may further include an alignment device (not illustrated) for aligning the recording medium discharged from the printer 100. The alignment device may have a structure for stapling the recording medium at an end portion thereof or punching a hole in an end portion of the recording medium. The finisher 400 may further include a stapler for stapling the paper at a center portion thereof. Other example processes or functions the finisher 400 may perform include hole punching, binding, embossing, gluing, coating, varnishing, foil stamping, texturing, lamination, cutting, creasing, stacking, binding, splicing, rewinding, or combinations thereof.

Figure 2:
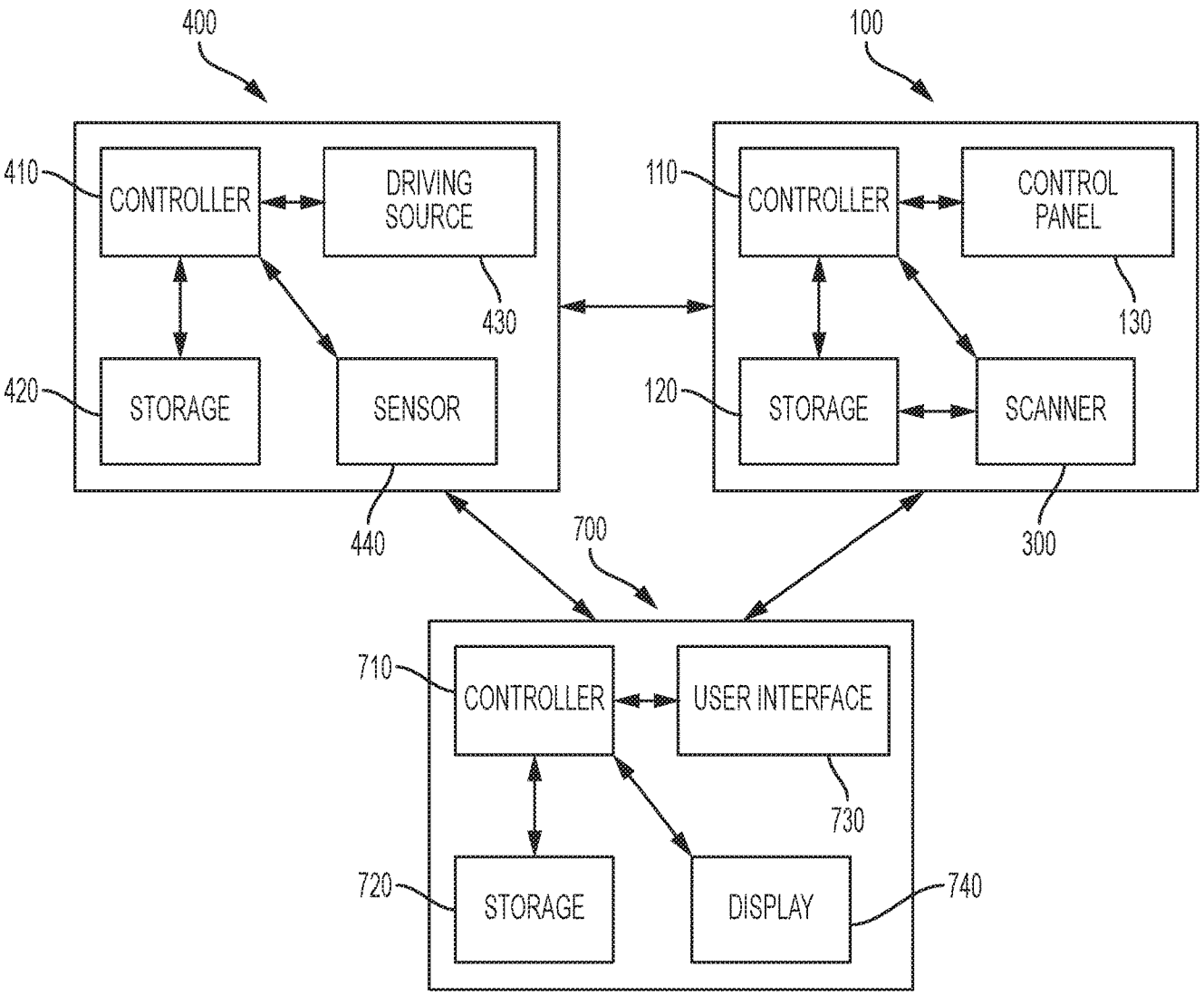
FIG. 2 is a block diagram of the printer and the finisher according to an example.

FIG. 2 is a block diagram of the printer 100, the finisher 400, and an external device 700, according to an example. In FIG. 2, the printer 100 includes controller 110 and machine readable storage 120, the finisher 400 includes controller 410 and machine readable storage 420, and the external device includes controller 710 and machine readable storage 720. The finisher 400 also includes a driving source 430 and a sensor 440 which will be discussed in more detail below. The driving source 430 may include a motor, solenoid, other electromechanical devices, or combinations thereof. The sensor 440 may include a position sensor that senses a position of a recording medium on a path in the finisher, a weight sensor, a proximity sensor, a light sensor, or combinations thereof.

The finisher 400 may include a controller 410 and machine readable storage 420. The controller 410 may execute instructions stored in the machine readable storage 420. The printer 100 may also include a controller 110 and machine readable storage 120. The finisher 400, the printer 100, and the external device 700 may be connected with one another in a wired and/or wireless manner such that the finisher 400, printer 100, and external device 700 can communicate with one another to exchange information, including job information regarding an image forming job performed or to be performed by the image forming apparatus including the printer 100 and scanner 300, a finishing job performed or to be performed by the finisher 400, or combinations thereof.

The controllers 110, 410, 710 may include, for example, a processor, an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof.

The machine readable storages 120, 420, 720 may be any electronic, magnetic, optical, or other physical storage device that stores executable instructions. For example, the machine readable storages 120, 420, 720 may include a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof.

The external device 700 may include a personal computer, a laptop, a tablet, a smartphone, a server, or combinations thereof. The external device 700 may be used to control the finisher 700, the printer 100, or combinations thereof. For example, the external device 700 may receive an input from a user regarding a job or function of the finisher 700, the printer 100, or combinations thereof. The external device 700 may include a user interface 730 to receive the input and a display 740 to display information regarding the finisher 400 and the printer 100. The user interface 730 may include, for example, a keyboard, a mouse, a joystick, a button, a switch, an electronic pen or stylus, a gesture recognition sensor, an input sound device or voice recognition sensor such as a microphone, an output sound device such as a speaker, a track ball, a remote control, a touchscreen, or combinations thereof. The external device 700 may also include a display 740.

Figure 3A:
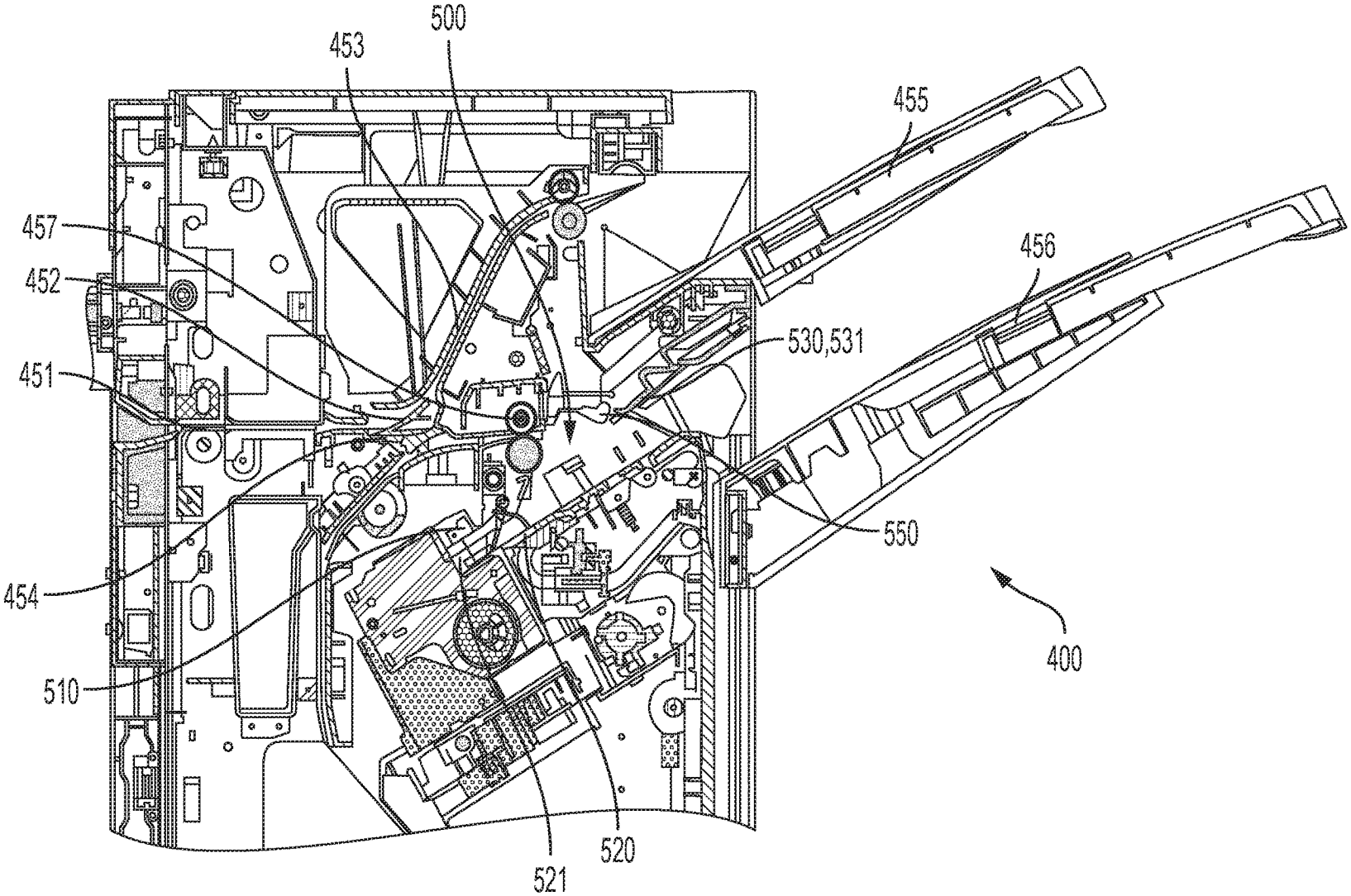
FIGS. 3A-3B are schematic cross-sectional views of the finisher according to an example.
Figure 3B:
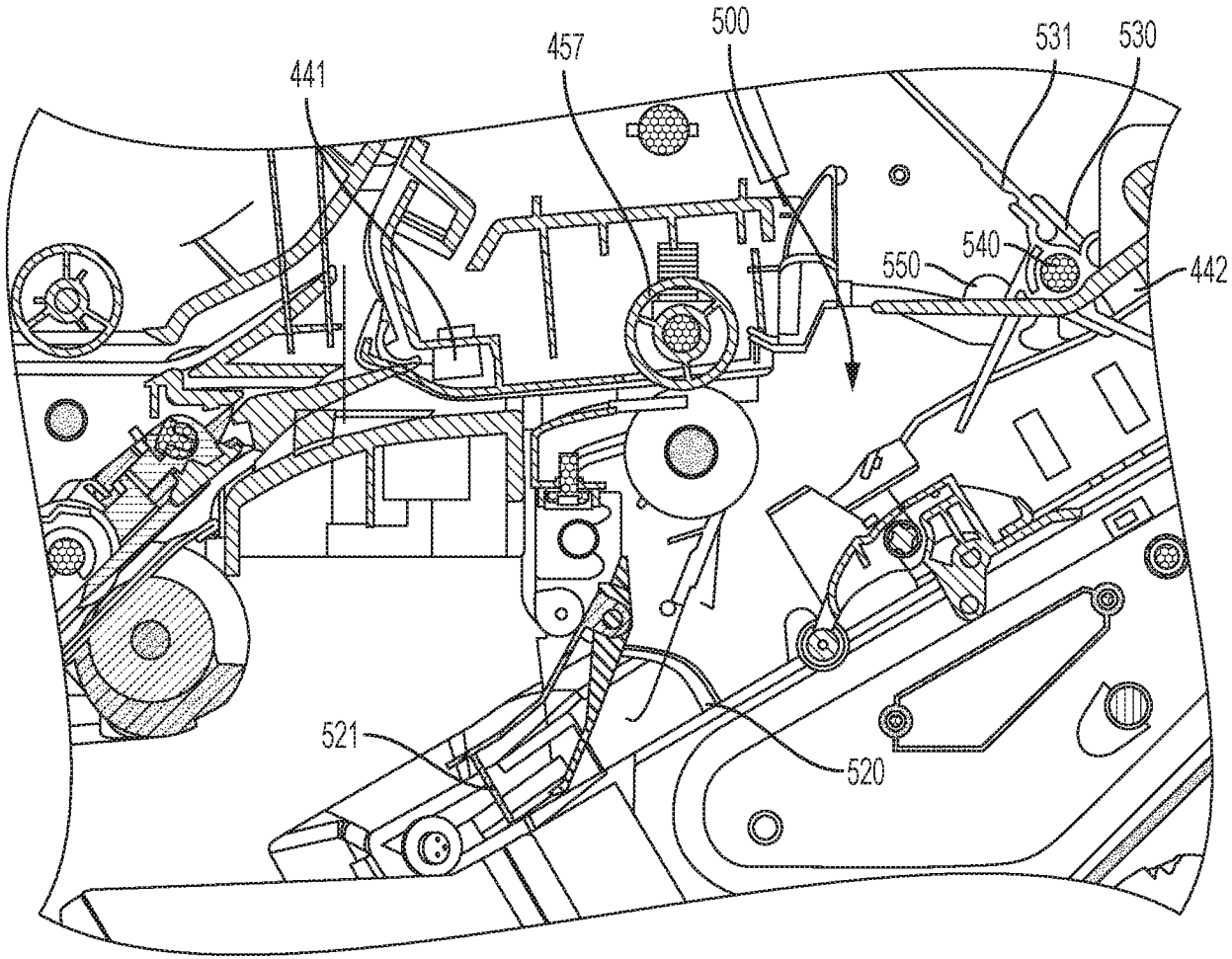

FIGS. 3A-3B are schematic cross-sectional views of the finisher according to an example.

Example paths traveled on by the recording medium in the finisher 400 will now be described. The recording medium is received by the finisher 400 from the printer 100 at an input port 451. Depending on the design of the finisher 400 and the processes to be performed on the recording medium, there may be numerous paths that the recording medium may be transported on before being output to an output bin. For example, as illustrated in FIG. 3A, a diverter 452 may divert the recording medium to an upper path 453 or a lower path 454 for the recording medium to be output to an upper output bin 455 or a lower output bin 456. Various rollers and other devices may contact and handle a recording medium within the finisher 400. The rollers and other devices may be driven by various motors, solenoids, and other electromechanical devices, which can be controlled via the controller 410 of the finisher 400, the controller 110 of the printer 100, or a controller located elsewhere, or by a combination thereof.

As illustrated in FIG. 3A, the finisher 400 includes an upper output bin 455 and a lower output bin 456. The upper output bin 455 may be utilized for simple jobs in which a finishing process or collated stacking is not performed. For example, a recording medium may be transported along the upper path 453 to be output to the upper output bin 455 when a stapling operation is not performed on the recording medium. The lower output bin 456 may be utilized for jobs for which a stacking or stapling operation is performed. For example, a recording medium may be transported along the lower path to be output to the lower output bin 456 when a stapling operation is performed on the recording medium. The lower output bin 456 may be movable. For example, the lower output bin 456 may be lowered or raised. The lower output bin 456 may be lowered or raised depending on a number of recording media that are held by the lower output bin 456.

When a finishing process is to be performed with respect to a recording medium and the recording medium is transported along the lower path 454, the recording medium may be transported to a section of the finisher 400 referred to as a compiler 500. The compiler 500 may include a stapler 510 to staple the recording medium to another recording medium or to recording media before the stapled media is ejected or discharged from the compiler 500 and output to the lower output bin 456. The compiler 500 may also include a register tray 520, a pusher bar 550 and a tamper (not shown), to be described in more detail below.

Figure 4A:
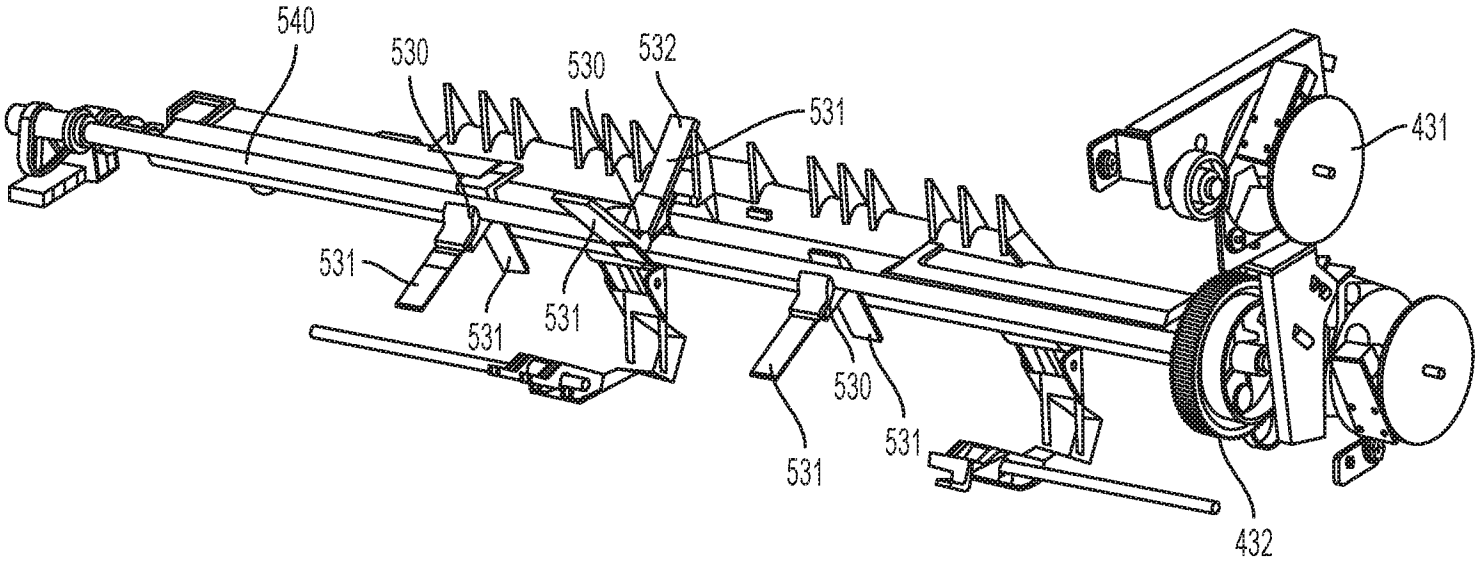
FIG. 4A is a perspective view illustrating a plurality of paddle units coupled to a rotatable shaft according to an example.
Figure 4B:
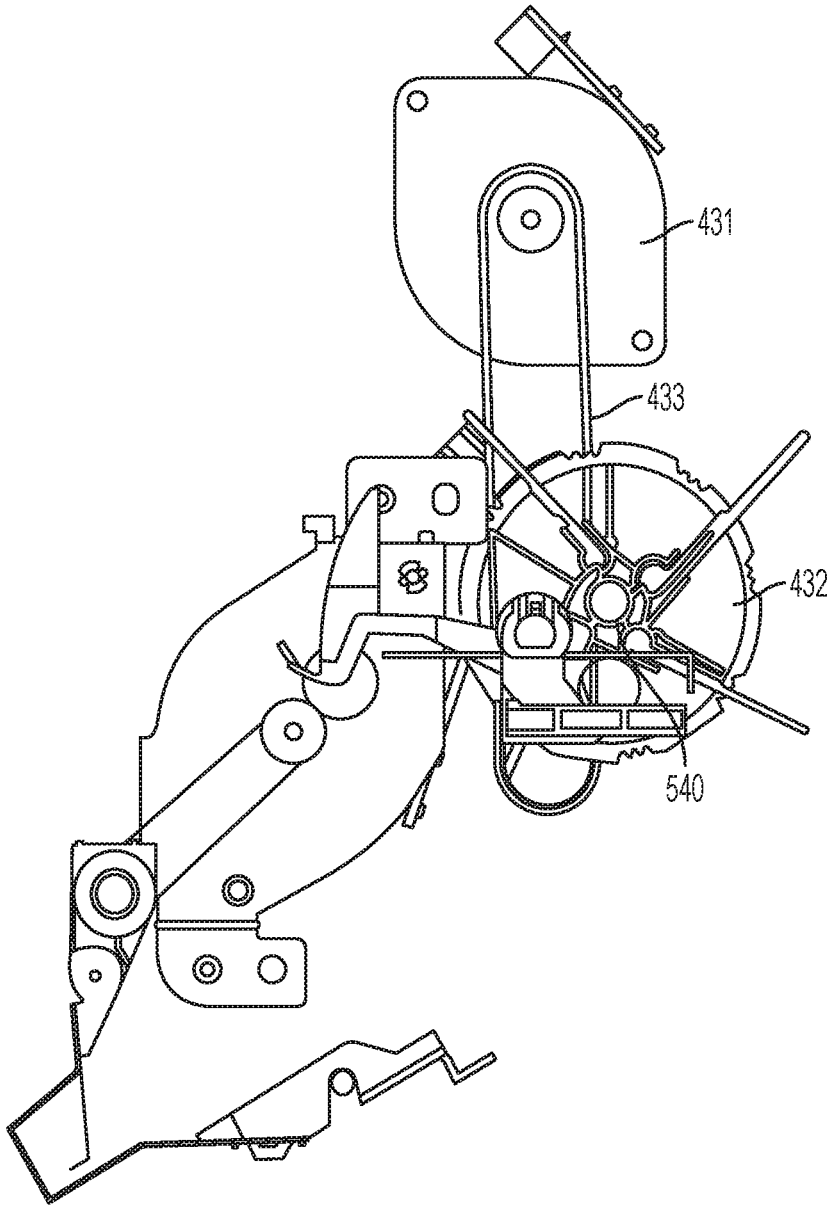
FIG. 4B is a side view illustrating a driving source coupled to a rotatable shaft according to an example.

FIG. 4A is a perspective view illustrating a plurality of paddle units 530 coupled to a rotatable shaft 540 according to an example. FIG. 4B is a side view illustrating a driving source coupled to a rotatable shaft according to an example. The compiler 500 may include the paddle units 530 coupled to the rotatable shaft 540 as shown in FIG. 4A.

As illustrated in FIG. 4A each of the paddle units 530 includes a plurality of paddles 531. The plurality of paddle units 530 coupled to the rotatable shaft 540 may be located at spaced apart intervals along the rotatable shaft 540 in an axial direction of the rotatable shaft 540. The plurality of paddles 531 can be at spaced apart intervals, circumferentially about the respective paddle unit 530. Each of the paddles 531 extends in a radial direction outward from the paddle unit 530 and rotatable shaft 540. For example, there may be three paddle units 530 coupled to the rotatable shaft 540. Each of the paddle units 530 may include two paddles 531 at spaced apart intervals, circumferentially about the respective paddle unit 530. However, the disclosure is not so limited and there may be more than three paddle units 530 or less than three paddle units 530. Furthermore, there may be more than two paddles 531 on a respective paddle unit 530, or less than two paddles 531. For example, there could be a single paddle unit 530 coupled to the rotatable shaft 540 where the paddle unit 530 has a single paddle 531. The paddle 531 may be made of polyurethane. However, the paddle 531 may be made of another material. For example, the material of the paddle 531 may be selected based on frictional characteristics. For example, the material of the paddle 531 may be selected so that the recording medium may be pulled back to the end portion 521 of the register tray 520 efficiently. As shown in FIG. 4A, the paddle 531 may have a substantially rectangular shape.

The driving source 430 may include a motor, a solenoid, another electromechanical device, or combinations thereof. For example, as illustrated in FIG. 4B the driving source 430 may include a motor 431, a gear 432 coupled to the rotatable shaft 540, and a driving belt 433 coupling the motor 431 to the gear 432 to drive rotation of the rotatable shaft 540 according to a signal output from the controller 410. The rotatable shaft 540 may be rotated in a first direction and a second direction by the driving source 430. The first direction may be referred to as a "forward" direction and the second direction may be referred to as a "reverse" direction. The first direction may be a clockwise direction and the second direction a counterclockwise direction. Or the first direction may be a counterclockwise direction and the second direction a clockwise direction. The paddles 531 rotate together with the rotation of the rotatable shaft 540. Because the paddles 531 are coupled to the rotatable shaft 540, when the rotatable shaft 540 is rotated in the forward direction, the paddles 531 rotate together with the rotatable shaft 540 in the forward direction. When the paddles 531 are rotated in the forward direction during a compiling operation, the paddles 531 compile a recording medium in a direction toward an end portion 521 of the register tray 520 so that the recording media, which are stacked on top of one another, are aligned at the end portion 521 of the register tray 520 and can be stapled together by the stapler 510 in a defined manner. As a number of recording media accommodated in the register tray 520 increases, a height of the compiled stack of recording media also increases.

An example path along which the recording medium travels to the compiler 500 will now be described with respect to FIG. 1. For example, with reference to FIGS. 3A and 3B the recording medium may pass through a pair of exit rollers 457 and drop down to the register tray 520. An exit roller sensor 441 located at or near the exit rollers 457 can detect a position of the recording medium. The exit roller sensor 441 may also be referred to as position sensor 441. The sensor 440 can include the exit roller sensor 441. For example, the exit roller sensor 441 can detect when the recording medium arrives at the exit rollers 457, passes through the exit rollers 457 to the register tray 520, or a combination thereof. For example, as illustrated in FIG. 3B, exit roller sensor 441 is located at a position upstream of the exit rollers 457. The exit roller sensor 441 may send a signal to the controller 410 indicating a position of the recording medium. For example, the signal may indicate the recording medium has arrived at the exit rollers 457 or has passed through the exit rollers 457 to the register tray 520. In this way the controller 410 can determine how many recording media are accommodated in the register tray 520 during a finishing operation. For example, the controller 410 can include a counter to count or index the number of recording media that have arrived at the exit rollers 457 or passed through the exit rollers 457 during the finishing operation.

As the recording medium drops down from the exit rollers 457 to the register tray 520 the pusher bar 550 may rotate to push downward against a trailing edge of the recording medium to assist the recording medium in dropping down to the register tray 520. When the recording medium is located on the register tray 520 the rotatable shaft 540 and paddles 531 may rotate in the forward direction. For example, during the compiling of the recording medium, the controller 410 may transmit a signal to the driving source 430 to control the driving source 430 to rotate the rotatable shaft 540 in the forward direction. Also, when the recording medium is located on the register tray 520 the tamper may be moved in an inward direction toward opposite sides of the recording media to align the stacked recording media in a widthwise direction of the recording medium. The tamper may be moved in the inward direction toward opposite sides of the recording media a plurality of times to align the stacked recording media in the widthwise direction.

Figure 5A:
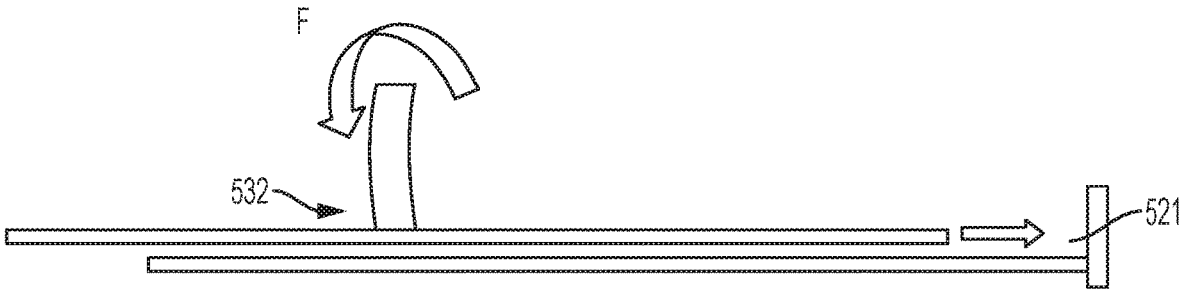
FIGS. 5A through 5C are side views illustrating a paddle rotating in a forward direction to compile a recording medium and rotating in a reverse direction to push down a buckle in the recording medium, according to an example.
Figure 5B:
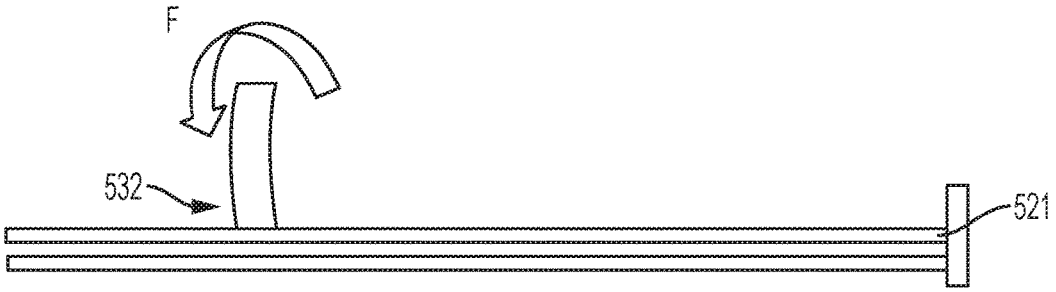
Figure 5C:
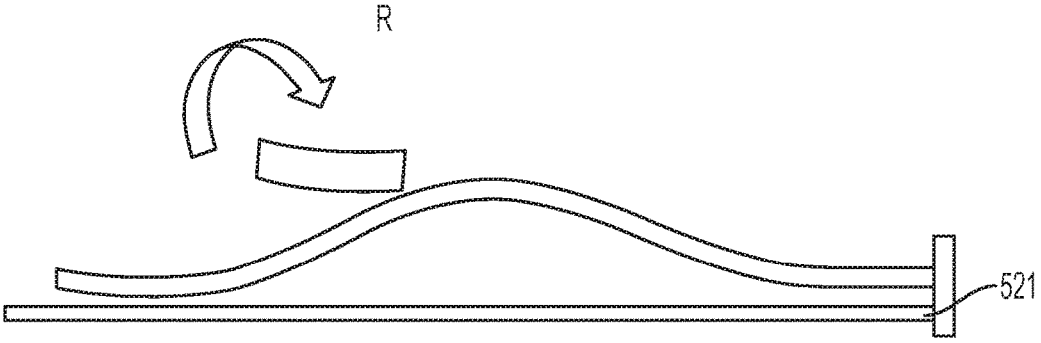

FIGS. 5A through 5C are side views illustrating a paddle rotating in a forward direction to compile a recording medium and rotating in a reverse direction to push down a buckle in the recording medium, according to an example. With reference to FIG. 5A, an end part 532 of the paddles 531 contacts an upper surface of the recording medium to pull the recording medium, for example by way of a frictional force, toward the end portion 521 of the register tray 520. The controller 410 can control a number of rotations of the rotatable shaft 540 and the paddles 531 coupled to the rotatable shaft 540 in the forward direction F. The controller 410 controls the number of rotations of the rotatable shaft 540 and the paddles 531 by transmitting a signal or command to a driving source 430 which drives rotation of the rotatable shaft 540. The driving source 430 may be a motor, for example. The signal or command indicates to the driving source 430 the number of times the rotatable shaft 540 should be rotated by the driving source 430 in the forward direction during a compiling operation with respect to the recording medium. A number of rotations of the rotatable shaft 540 in the forward direction for compiling a recording medium can vary. For example, the controller 410 can determine the number of rotations of the rotatable shaft 540 in the forward direction based on information regarding the recording medium, information regarding the finishing operation, or combinations thereof. Information regarding the recording medium and finishing operation may be obtained from the printer 100, the finisher 400 itself, from another source, or combinations thereof. For example, the information may include a type of recording medium, a height of the stack of the recording media, a thickness of the recording medium, an amount of ink content on the recording medium, or combinations thereof.

For example, the rotatable shaft 540 may be rotated such that the paddles 531 contact the recording medium a plurality of times to move the recording medium toward the end portion 521 of the register tray 520. When the number of forward compiling motions increases the recording medium may be over-compiled such that the recording medium becomes buckled.

The controller 410 can control a speed of rotation of the rotatable shaft 540 and the paddles 531 coupled to the rotatable shaft 540. The controller 410 controls the speed of rotation of the rotatable shaft 540 by transmitting a signal or command to a driving source 430 which drives rotation of the rotatable shaft 540. The driving source 430 may be a motor, for example. The signal or command indicates to the driving source 430 a speed at which the rotatable shaft 540 should be driven by the driving source 430. For example, the speed of the rotation of the rotatable shaft 540 in the forward direction may be set by the controller 410 based on a throughput speed to be obtained, on a type of recording medium, on an amount of ink content on the recording medium, or combinations thereof. A speed of the rotation of the rotatable shaft 540 and paddles 531 in the reverse direction may also be varied by the controller 410. A speed of the rotation of the rotatable shaft 540 and paddles 531 in the reverse direction may be less than a speed of the rotation of the rotatable shaft 540 and paddles 531 in the forward direction for compiling a recording medium. A number of times that the paddles 531 are rotated in the reverse direction may also be less than a number of times that the paddles 531 are rotated in the forward direction for compiling a recording medium.

With reference to FIGS. 5B and 5C, as a height of the recording media stacked in the register tray 520 increases, or as a number of forward compiling motions by the paddles 531 increase, a buckling of a recording medium may occur when the paddles 531 apply a force to the recording medium while being rotated in the forward direction such that the recording medium is over-compiled. As shown in FIG. 5C, to reduce or eliminate the buckling of the recording medium the rotatable shaft 540 and the paddles 531 can be rotated in the reverse direction R such that the paddles 531 apply a downward force to the recording medium to push down the recording medium toward the register tray 520. For example, the paddles 531 may apply a downward force in a direction normal to or substantially normal to the register tray 520 to flatten the recording medium.

In rotating the paddles 531 in the reverse direction pulling the recording medium away from the end portion 521 of the register tray 520 should be avoided. Therefore, an amount of rotation of the paddles 531 in the reverse direction can be controlled by the controller 410. For example, an amount of rotation of the paddles 531 in the reverse direction can be controlled by the controller 410 based on a height of the stack of recording media in the register tray 520.

Figure 6A:
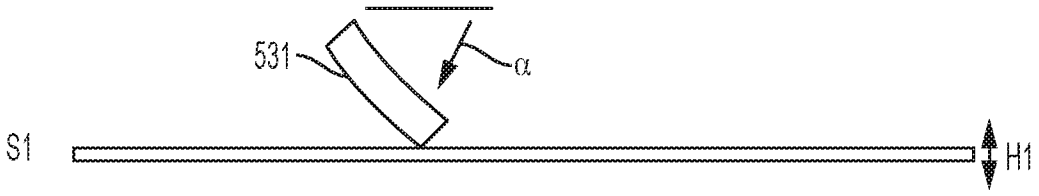
FIGS. 6A and 6B are side views illustrating different amounts of rotation of a paddle in the reverse direction based on a height of the recording medium, according to an example.
Figure 6B:
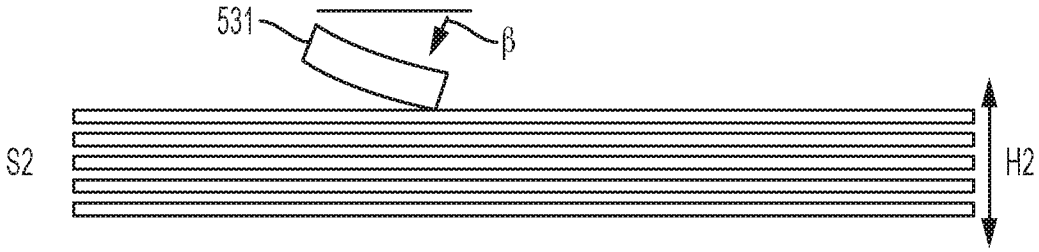

FIGS. 6A and 6B are side views illustrating different amounts of rotation of a paddle in the reverse direction based on a height of the recording medium, according to an example. For example, as illustrated in FIG. 6A, when the stack of recording media S1 is a first height h1, the paddle 531 may be rotated a first predetermined amount a. For example, as illustrated in FIG. 6B, when the stack of recording media S2 is a second height h2, the paddle 531 may be rotated a second predetermined amount 13 which is less than the first predetermined amount a. As shown in FIGS. 6A and 6B, the amount of rotation may be described with respect to a horizontal plane or may be described with respect to a rotational axis of the rotatable shaft 540.

The height of the stack of recording media can be determined in various manners. As an example, when a job is received at the printer 100, the printer 100 may communicate with the finisher 400 by transmitting a signal including job information to the finisher 400 that identifies, or is indicative of, various characteristics pertaining to the job. For example, the job information may include a number of recording media to be compiled, a type of recording medium, a thickness of the recording medium, an ink content on the recording medium, or combinations thereof. The job information may be in the form of a code.

The controller 410 of the finisher 400 can interpret the job information received from the printer 100, for example by interpreting the code, to obtain the job information. The controller 410 can store the job information in the machine readable storage 420. Further, as discussed above the controller 410 can determine when a recording medium arrives at the exit rollers 457 or passes through the exit rollers 457 by receiving a signal from the exit roller sensor 441. In this way the controller 410 can determine a number of sheets placed on the register tray 520 at any particular time during a compiling operation.

For example, the controller 410 can determine a height of the stack based on the determined number of sheets in the register tray 520 and an assumed or default thickness value of a recording medium. For example, if the controller 410 determines 50 sheets of recording media are placed on the register tray 520 based on the signal received from the exit roller sensor 441 and utilizes a default thickness value for the recording medium of 0.05 mm, the controller 410 can perform a processing operation to calculate the height of the stack of recording media to be 2.5 mm. Based on the calculated height of the stack, the controller 410 can transmit a signal to the driving source 430 to control the driving source 430 to rotate the rotatable shaft 540 in the reverse direction by a specified amount during the compiling operation.

For example, the controller 410 may reference a lookup table stored in the machine readable storage 420 to determine that for a height of 2.5 mm, the rotatable shaft 540 should be rotated in the reverse direction by 10 degrees during the compiling operation. The controller 410 can transmit a signal to the driving source 430 to control the driving source 430 to rotate the rotatable shaft 540 in the reverse direction by the specified amount during the compiling operation.

For example, if the controller 410 subsequently determines 75 sheets of recording media are placed on the register tray 520 based on the signal received from the exit roller sensor 441, and utilizes a default thickness value for the recording medium of 0.05 mm, the controller 410 can perform a processing operation to calculate the height of the stack of recording media to be 3.75 mm by multiplying 75 with 0.05. Based on the calculated height of the stack, the controller 410 can transmit a signal to the driving source 430 to control the driving source 430 to rotate the rotatable shaft 540 in the reverse direction by a specified amount during the compiling operation. For example, the controller 410 can reference a lookup table stored in the machine readable storage 420 to determine that for a height of 3.75 mm, the rotatable shaft 540 should be rotated in the reverse direction by 5 degrees during the compiling operation. The controller 410 can transmit a signal to the driving source 430 to control the driving source 430 to rotate the rotatable shaft 540 in the reverse direction by the specified amount during the compiling operation.

As another example, the controller 410 could omit the operation of calculating a height of the stack, and determine an amount of rotation in the reversed direction based on the number of sheets. For example, the controller 410 can reference a lookup table stored in the machine readable storage 420 to determine that for 50 sheets placed in the register tray 520, the rotatable shaft 540 should be rotated in the reverse direction by 10 degrees during the compiling operation, and that for 75 sheets placed in the register tray 520, the rotatable shaft 540 should be rotated in the reverse direction by 5 degrees during the compiling operation. The amounts of rotation in the reverse direction described above are merely examples. In accordance with the above described examples, the amount of rotation of the rotatable shaft 540 in the reverse direction decreases as the height of the stack of media increases.

As another example, the controller 410 can determine a height of the stack based on the determined number of sheets in the register tray 520 and a thickness of the recording medium determined according to the job information received from the printer 110. For example, if the controller 410 determines from the job information that the type of recording medium is standard A4 paper, and a thickness of A4 paper is 0.05 mm, then the controller 410 can calculate the height of the stack of media by multiplying the number of sheets of A4 paper that have passed through the exit roller with the thickness value of the A4 paper which can be stored in the machine readable storage 420.

The controller 410 can determine a height of the stack based on a per sheet or per page basis, or can utilize a default height value for an interval of number of recording media in the register tray 520. For example, when the number of recording of media in the register tray 520 is within a first interval (e.g., between 0 and a first predetermined number of recording media), the height may be determined to be a first predetermined height value. The first predetermined height value can be a nominal or average height value of the first interval. As an example, based on the signal received by the controller 410 from the exit roller sensor 441, the controller 410 can determine or infer a number of recording media placed on the register tray 520. For example, if the number of recording media placed on the register tray 520 is 1 to 50, the controller 410 may reference a lookup table stored in the machine readable storage 420 to determine a height of 1.25 mm as the first predetermined height value. An amount of rotation of the rotatable shaft 540 in the reverse direction can then be determined by the controller 410 based on the obtained first predetermined height value.

For example, when the number of recording media in the register tray 520 is within a second interval (e.g., between the first predetermined number of recording media and a second predetermined number of recording media), the height may be determined to be a second predetermined height value. The second predetermined height value can be a nominal or average height value of the second interval. For example, if the number of recording media placed on the register tray 520 is 51 to 100, the controller 410 may reference a lookup table stored in the machine readable storage 420 to determine a height of 3.75 mm as the second predetermined height value. An amount of rotation of the rotatable shaft 540 in the reverse direction can then be determined by the controller 410 based on the obtained second predetermined height value.

In the above description two intervals have been described. However, the number of intervals may be more than two.

The finisher 400 can determine a height of the stack of media according to other methods. For example, the finisher 400 could determine a height of the stack based on a weight of the stack of media determined using a weight sensor. The sensor 440 can include the weight sensor. The weight sensor can transmit a signal to the controller 410 which indicates the weight of the stack of media. The controller 410 can reference a lookup table stored in the machine readable storage 420 based on the total weight to determine an amount the rotatable shaft 540 should be rotated in the reverse direction during the compiling operation. For example, if the controller 410 receives a signal from the weight sensor indicating a total weight of the stack of media is 250 grams, the controller 410 can determine from the lookup table that the rotatable shaft 540 should be rotated in the reverse direction by 10 degrees during the compiling operation, and that for a total weight of 500 grams, the rotatable shaft 540 should be rotated in the reverse direction by 5 degrees during the compiling operation. However, the total weight of the stack of media may not directly correlate with the height of the stack of recording media as certain media may be heavier than others.

As another example, based on the total weight of the stack of media in the register tray 520, a weight of a single recording medium, and a thickness of the recording medium, the controller 410 can determine a number of sheets in the stack and thereafter determine a height of the stack of media. For example, the weight of the single recording medium and the thickness of the recording medium can be determined based on the job information received from the printer 100 or by reference to information stored in the machine readable storage 420. For example, if the total weight sensed by the weight sensor is 250 grams, and the controller 410 receives job information from the printer 100 indicating each recording medium has a thickness of 0.05 mm and a weight of 5 grams, the controller 410 can calculate that 50 sheets are in the register tray 520 and have a stack height of 2.5 mm. An amount of rotation of the rotatable shaft 540 in the reverse direction can then be determined by the controller 410 based on the calculated stack height.

As another example, the finisher 400 may determine a height of the stack based on a proximity sensor or light sensor that measures a distance to an object. For example, the sensor 440 can include a height sensor 442 (see FIG. 3B) such as a proximity sensor and/or the light sensor located above the registration tray 520 where paddling of the recording medium is performed. The measured distance can be used to calculate or infer a height of the stack of media. The height sensor 442 may be located within the compiler 500 at a location capable of measuring the height of the media in the register tray 520 and the height information may be transmitted to the controller 410. The height sensor 442 can calculate the height of the stack media using time-of-flight principles, for example. The height sensor 442 can transmit a signal to the controller 410 which includes the height information regarding the stack of media. An amount of rotation of the rotatable shaft 540 in the reverse direction can then be determined by the controller 410 based on the height information received from the height sensor 442.

As described above, the amount of rotation of the paddle 531 in the reverse direction can vary according to the determined height of the stack of media in the register tray 520. The amount of rotation can be determined by the controller 410 according to various methods.

For example, the controller 410 can execute instructions stored in the machine readable storage 420 to control the driving source 430 of the rotatable shaft 540 such that the amount of rotation of the rotatable shaft 540 and paddles 531 in the reverse direction changes any time an increase in height of the stack is determined. That is, the amount of rotation of the rotatable shaft 540 in the reverse direction can vary each time a recording medium is added to the stack of media, in an incremental fashion.

As an example, when the controller 410 receives a signal from the exit roller sensor 441, the controller 410 can calculate the height of the stack of media in the register tray 520 in accordance with one of the processes discussed above. Then the controller 410 can transmit a signal to the driving source 430 to control the driving source 430 to rotate the rotatable shaft 540 in the reverse direction by a specified amount during the compiling operation. For example, the controller 410 can reference a lookup table stored in the machine readable storage 420 to determine that for a height of 3.75 mm, the rotatable shaft 540 should be rotated in the reverse direction by 5 degrees during the compiling operation. If the controller 410 receives a signal from the exit roller sensor 441 indicating an additional recording medium is placed on the register tray, the controller 410 may calculate an updated height of 3.80 mm. The controller 410 can again reference the lookup table stored in the machine readable storage 420 to determine that for a height of 3.80 mm, the rotatable shaft 540 should be rotated in the reverse direction by 4 degrees during the compiling operation.

As another example, the controller 410 can execute instructions stored in the machine readable storage 420 to control the driving source 430 of the rotatable shaft 540 such that the amount of rotation of the rotatable shaft 540 and paddles 531 in the reverse direction changes at predetermined height intervals. That is, the amount of rotation of the rotatable shaft 540 in the reverse direction can be varied at predetermined height intervals of the stack.

For example, when the height of the stack of media is a first height interval (e.g., between 0 and a first predetermined height), the paddles 531 may be rotated in the reverse direction by a first predetermined amount. For example, if the height of the stack of media placed on the register tray 520 is greater than 0 mm and less than 2.5 mm, the controller 410 may reference a lookup table stored in the machine readable storage 420 to determine an amount of rotation of 10 degrees as the first predetermined amount.

For example, when the height of the stack of media is a second height interval (e.g., between the first predetermined height and a second predetermined amount), the paddles 531 may be rotated in the reverse direction by a second predetermined amount. For example, if the height of the stack of media placed on the register tray 520 is equal to or greater than 2.55 mm and less than 5.0 mm, the controller 410 may reference a lookup table stored in the machine readable storage 420 to determine an amount of rotation of 5 degrees as the second predetermined amount.

In the above description two intervals have been described. However, the number of intervals may be more than two.

The controller 410 may control the driving source 430 in a manner such that the driving source 430 is selectively controlled to rotate the paddles 531 in the reverse direction during compiling of a recording medium. For example, the controller 410 may receive job information from the printer 100 or another source indicating the recording medium to be compiled is a type of recording medium for which buckling is unlikely to occur during compiling. For example, a recording medium having a thickness greater than a predetermined amount may be less likely to buckle during compiling. For example, the recording medium having the thickness greater than the predetermined amount may be cardstock. Therefore, the controller 410, based on the received job information, may control the driving source 430 such that rotation of the paddles 531 in the reverse direction is not performed during compiling of the recording medium having the thickness greater than the predetermined amount. On the other hand, the controller 410 may receive job information from the printer 100 or another source indicating the recording medium to be compiled is a type of recording medium for which buckling may occur during compiling. For example, a recording medium having a thickness less than the predetermined amount may be more likely to buckle during compiling. Therefore, the controller 410, based on the received job information, may control the driving source 430 such that rotation of the paddles 531 in the reverse direction is performed during compiling of the recording medium having the thickness less than the predetermined amount.

As another example, the controller 410 may receive other job information from the printer 100 or another source indicating the recording medium to be compiled is a type of recording medium for which buckling is unlikely to occur during compiling. For example, a recording medium having an ink content less than a predetermined amount may be less likely to buckle during compiling. Therefore, the controller 410, based on the received job information, may control the driving source 430 such that rotation of the paddles 531 in the reverse direction is not performed during compiling of the recording medium having the ink content less than the predetermined amount. On the other hand, the controller 410 may receive job information from the printer 100 or another source indicating the recording medium to be compiled is a type of recording medium for which buckling may occur during compiling. For example, a recording medium having an ink content more than the predetermined amount may be more likely to buckle during compiling. Therefore, the controller 410, based on the received job information, may control the driving source 430 such that rotation of the paddles 531 in the reverse direction is performed during compiling of the recording medium having the ink content more than the predetermined amount. The controller 410 may determine whether to control the driving source 430 such that rotation of the paddles 531 in the reverse direction is performed or not performed during compiling of the recording medium based on a combination of considerations, for example based on both the thickness of the recording medium and the amount of ink content on the recording medium.

As discussed above, the controller 410 may refer to a look-up table stored in the machine readable storage 420 of the finisher 400 or stored in a memory elsewhere, to determine an amount of rotation of the rotatable shaft 540 in the reverse direction according to a determined height of the stack of media. The controller 410 may also refer to a look-up table stored in the machine readable storage 420 of the finisher 400 or stored in a memory elsewhere, to determine the height of the stack of media in the register tray 520 according to a number of sheets in the register tray 520.

When the recording media have been compiled in the register tray 520, a finishing process can be performed on the recording media and the finished recording media can be discharged or ejected from the compiler 500 to the lower output bin 456 for retrieval by a user. For example, the stapler 510 can perform a stapling operation on the recording media when the recording media has been compiled. The stapled recording media can be ejected or discharged from the compiler 500 to the lower output bin 456. For example, the stack of finished recording media can be ejected or discharged from the compiler 500 using a clamp that clamps an edge of the stack of finished recording media, and ejector arms and a conveying belt that push the stack of finished recording media out to the lower output bin.

As discussed above, paddles coupled to a rotatable shaft of the compiler can be rotated in a reverse direction to push down a recording medium toward the register tray to reduce or eliminate a buckling of the recording medium during a compiling operation. An amount of rotation of the paddles in the reverse direction can be varied according to a number of recording media stacked in the register tray or a height of the recording media stacked in the register tray. The height of the recording media stacked in the register tray can be determined by a controller according to various processes including the non-limiting examples described herein. The amount of rotation of the paddles in the reverse direction can be determined by a controller according to various processes including the non-limiting examples described herein. The reverse rotation of the paddles pushes a buckle of the recording medium down to flatten the recording medium. The amount of rotation of the rotatable shaft and the paddles in the reverse direction can be controlled by a controller based on a height of the stack of media in the register tray. The rotation of the paddles in the reverse direction, and the ability to variably control the amount of rotation in the reverse direction, can help prevent a paper jam in the compiler and can help prevent poor edge registration of a stapled job, for example.

Executable instructions to perform processes or operations in accordance with the above-described examples may be recorded in a machine readable storage. A controller may execute the executable instructions to perform the processes or operations. Examples of instructions include both machine code, such as that produced by a compiler, and files containing higher level code that may be executed by the controller using an interpreter. The instructions may be executed by a processor or a plurality of processors included in the controller. The machine readable storage may be distributed among computer systems connected through a network and computer-readable codes or instructions may be stored and executed in a decentralized manner.

The foregoing examples are merely examples and are not to be construed as limiting the disclosure. The disclosure can be readily applied to other types of apparatuses. Also, the description of the examples of the disclosure is intended to be illustrative, and not to limit the scope of the claims.

What is claimed is:

1. A paddle apparatus for a finisher, comprising:
a rotatable shaft; and
a paddle coupled to the rotatable shaft,
the paddle rotatable in a forward direction to compile a recording medium toward an end of a register tray of the finisher, and
the paddle rotatable in a reverse direction, by a controlled variable amount determined based on a height of the compiled recording medium placed in the register tray, to apply a downward force to the compiled recording medium.

2. The paddle apparatus of claim 1, wherein
for a first height of the compiled recording medium, the paddle is rotated in the reverse direction a first amount, and
for a second height of the compiled recording medium, the paddle is rotated in the reverse direction a second amount, the second amount being less than the first amount when the second height is greater than the first height.

3. The paddle apparatus of claim 1, wherein for compiling the recording medium, the paddle is to be rotated in the forward direction to compile the recording medium toward the end of the register tray a plurality of times, and the paddle is to be rotated in the reverse direction less than the plurality of times.

4. The paddle apparatus of claim 1, wherein the paddle is rotatable in the forward direction to compile the recording medium toward the end of the register tray at a first predetermined speed, and the paddle is rotatable in the reverse direction at a second predetermined speed which is less than the first predetermined speed.

5. The paddle apparatus of claim 1, wherein during compiling the recording medium, a height of the recording medium when the paddle contacts the recording medium during a first rotation of the paddle in the forward direction to compile the recording medium toward the end of the register tray is less than the height of the recording medium when the paddle contacts the recording medium during rotation of the paddle in the reverse direction to apply the downward force to the compiled recording medium.

6. A finisher, comprising:
an input port to receive a recording medium; and
a compiler section to receive the recording medium transported from the input port along a path within the finisher and to perform a finishing operation with respect to the recording medium, the compiler section including:
a register tray,
a rotatable shaft, and
a paddle coupled to the rotatable shaft,
the paddle rotatable in a forward direction to compile the recording medium toward an end of the register tray, and
the paddle rotatable in a reverse direction, by a controlled variable amount determined based on a height of the compiled recording medium placed in the register tray, to apply a downward force to the compiled recording medium.

7. The finisher of claim 6, further comprising a controller to determine the height of the compiled recording medium based on at least one of a number of recording media placed in the register tray, a thickness of the recording medium, or a type of the recording medium.

8. The finisher of claim 6, further comprising a controller to determine an amount the paddle is to be rotated in the reverse direction based on at least one of a number of recording media placed in the register tray or a thickness of the recording medium.

9. The finisher of claim 8, further comprising:
an exit roller to receive the recording medium transported along a path from the input port and to discharge the recording medium to the compiler section;
an exit roller sensor to generate a signal when a recording medium is when transported from the exit roller to the compiler section; and
a controller to receive the signal generated by the exit roller sensor, to determine a number of recording media placed on the register tray based on the signal, and to determine an amount of rotation of the paddle in the reverse direction based on the number of recording media.

10. The finisher of claim 8, further comprising:
a driving source to drive rotation of the rotatable shaft;
a machine readable storage to store a lookup table which includes a correspondence between the height of the compiled recording medium placed in the register tray and an amount of rotation of the paddle in the reverse direction; and a controller to determine the amount of rotation of the paddle in the reverse direction by referencing the lookup table and to transmit a control signal to control the driving source to rotate the rotatable shaft in the reverse direction by the determined amount of rotation of the paddle.

11. The finisher of claim 6, further comprising a controller to selectively rotate the paddle in the reverse direction during compiling of the recording medium based on at least one of a type of the recording medium or a thickness of the recording medium.

12. The finisher of claim 6, further comprising:

a driving source to drive rotation of the rotatable shaft; and a controller to control the driving source to rotate the rotatable shaft in the reverse direction by a first amount for a first height of the compiled recording medium, and to control the driving source to rotate the rotatable shaft in the reverse direction by a second amount for a second height of the compiled recording medium, the second amount being less than the first amount when the second height is greater than the first height.

13. The finisher of claim 6, further comprising:

a sensor to determine a height of the compiled recording medium and to generate a signal indicating the height of the compiled recording medium; and a controller to receive the signal generated by the sensor indicating the height of the compiled recording medium, and to determine an amount the paddle is to be rotated in the reverse direction based on the signal.

14. A non-transitory machine readable storage comprising instructions that when executed cause at least one processor of a finisher to:

control a driving source of the finisher, based on job information relating to a recording medium to be processed by the finisher, to rotate a rotatable shaft in a compiling section of the finisher in a forward direction such that a paddle coupled to the rotatable shaft compiles the recording medium in a register tray of the finisher; and control the driving source, based on the job information, to rotate the rotatable shaft in a reverse direction by a controlled variable amount based on a height of the compiled recording medium in the register tray, such that the paddle applies a downward force to the compiled recording medium.

15. The non-transitory machine readable storage of claim 14, wherein the non-transitory machine readable storage further comprises instructions that when executed cause the at least one processor to:

determine the height of the compiled recording medium in the register tray based on the job information, the job information including at least one of a number of recording media to be processed by the finisher, a type of the recording medium, a thickness of the recording medium, or an amount of ink content on the recording medium.

* * * * *